US009689218B1

(12) United States Patent
McDaniel

(10) Patent No.: US 9,689,218 B1
(45) Date of Patent: Jun. 27, 2017

(54) DRILL CUTTINGS DIVERTER SYSTEM

(71) Applicant: Thomas McDaniel, Creole, LA (US)

(72) Inventor: Thomas McDaniel, Creole, LA (US)

( * ) Notice: Subject to any disclaimer, the term of this patent is extended or adjusted under 35 U.S.C. 154(b) by 242 days.

(21) Appl. No.: 14/639,099

(22) Filed: Mar. 4, 2015

Related U.S. Application Data

(60) Provisional application No. 61/947,973, filed on Mar. 4, 2014.

(51) Int. Cl.
*E21B 21/06* (2006.01)
*E21B 21/01* (2006.01)
*E21B 21/00* (2006.01)

(52) U.S. Cl.
CPC ..... *E21B 21/065* (2013.01); *E21B 21/01* (2013.01); *E21B 2021/007* (2013.01)

(58) Field of Classification Search
CPC .. E21B 21/065; E21B 21/01; E21B 2021/007; E21B 21/06
See application file for complete search history.

(56) References Cited

U.S. PATENT DOCUMENTS 5,193,372 A * 3/1993 Sieg ..... E05B 9/084 70/369
5,839,521 A 11/1998 Dietzen
5,842,529 A * 12/1998 Dietzen ..... B63B 27/20 175/206
5,913,372 A 6/1999 Dietzen
5,971,084 A * 10/1999 Dietzen ..... B63B 27/20 175/207
6,009,959 A 1/2000 Dietzen
6,170,580 B1 1/2001 Reddoch
6,213,227 B1 4/2001 Dietzen
6,345,672 B1 2/2002 Dietzen
6,585,115 B1 7/2003 Reddoch et al.
7,033,124 B2 4/2006 Snowdon
7,186,062 B2 3/2007 Snowdon
7,195,084 B2 3/2007 Burnett et al.
7,503,406 B2 3/2009 Seaton et al.
7,506,702 B1 3/2009 Patterson et al.
7,575,072 B2 8/2009 Reddoch, Sr.
7,753,126 B2 7/2010 Reddoch, Sr.
7,830,617 B2 * 11/2010 Kweon ..... G02B 3/02 359/642
7,886,848 B1 2/2011 Patterson et al.
8,096,371 B1 1/2012 Patterson et al.
8,267,201 B1 9/2012 Patterson et al.
8,322,464 B2 12/2012 Reddoch, Sr.
8,528,666 B1 9/2013 Patterson et al.
8,651,201 B2 * 2/2014 Hollier ..... E21B 21/065 175/206

(Continued)

*Primary Examiner* — Yong-Suk (Philip) Ro
(74) *Attorney, Agent, or Firm* — Greg R. Mier

(57) ABSTRACT

A drill cuttings diverter system for distributing downhole drill cuttings inside a cuttings box, where the drill cuttings diverter system is equipped with a diverter conduit having a bottom that is concaved toward a side opening. The diverter conduit is rotatably inserted through an opening in the cuttings box so that the operator can rotate the side opening at the bottom of the diverter conduit to change the direction of the drill cuttings being fed into the cuttings box, and thereby prevent the drill cuttings from accumulating in a single pile inside the cuttings box.

17 Claims, 3 Drawing Sheets

(56) References Cited

U.S. PATENT DOCUMENTS

| | | | | |
|---|---|---|---|---|
| 2006/0102390 | A1* | 5/2006 | Burnett | B63B 27/20 175/66 |
| 2013/0228380 | A1* | 9/2013 | Farrar | E21B 21/01 175/66 |
| 2014/0158431 | A1* | 6/2014 | Anderson | E21B 41/005 175/57 |

* cited by examiner

SECTION A1-A1

DRILL CUTTINGS DIVERTER SYSTEM

CROSS REFERENCE TO RELATED APPLICATIONS

The present application claims priority from provisional patent application No. 61/947,973, filed on Mar. 4, 2014.

FIELD OF THE INVENTION

The present invention is an apparatus and method for containing drill cuttings in a cuttings box during the process of drilling a well.

BACKGROUND

In many oil and gas operations, the handling and disposal of the drilling fluid and the material entrained in the drilling fluid during the drilling process, commonly known as the drill cuttings, has become an increasingly difficult problem. Environmental regulations and considerations prohibit or make undesirable the surface disposal of so-called drill cuttings. Therefore, drill cuttings must be contained for disposal or other use.

As is well known in the drilling industry, shakers and other equipment are used to remove the drill cuttings from the drilling fluid before the drilling fluid is redirected down into the well. The removed drill cuttings are typically transferred from the shaker to large boxes for disposal away from the drilling location. These large boxes are known as "cuttings boxes," and can have a capacity of twenty-five (25) oil field barrels and are typically made of metal.

While various means of transferring the cuttings into the cuttings boxes are used, one common system is a vacuum system. Vacuum systems use a high-volume air stream at pressures typically slightly below atmospheric, which pull the drill cuttings through a pipe, hose, or other conduit, to an inlet in the cuttings box, where the drill cuttings fall into the cuttings box. As the drill cuttings fall into the cuttings box, they begin to accumulate below the inlet of the cuttings box. The accumulation of drill cuttings forms a pyramid-shaped pile under the inlet until the top of the pyramid-shaped pile reaches the inlet. At that point, either the cuttings box is considered full, or the lid of the cuttings box has to be opened to manually distribute the drill cuttings more evenly inside the cuttings box.

A typical cuttings box is a generally elongated box having at least one hinged lid on the top and a hinged relief hatch on the top. The hinged lid is typically bolted shut with a number of nuts and bolts, and can be very heavy. To open the lid for access to the interior of the cuttings box, all of the nuts and bolts must be removed (which is time consuming), and the lid rotated back on its hinges. Due to the weight of the lid, and the various pinch points presented, a number of accidents have occurred in the process of manipulating the lid. These accidents occur because workers are typically in a hurry to get the lid opened and closed. In addition, at least two workers are generally required to perform the lid opening and/or closing.

The present invention provides an apparatus and method that eliminates the need to remove the lid of a cuttings box to manually distribute drill cuttings more evenly inside the cuttings box.

BRIEF DESCRIPTION OF THE DRAWING

The accompanying drawings are provided for the purpose of illustration only and are not intended as a definition of the limits of the present invention. The drawings illustrate a preferred embodiment of the present invention, wherein.

DESCRIPTION OF THE INVENTION

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof) falling within the scope of the appended claims.

Figure 1:
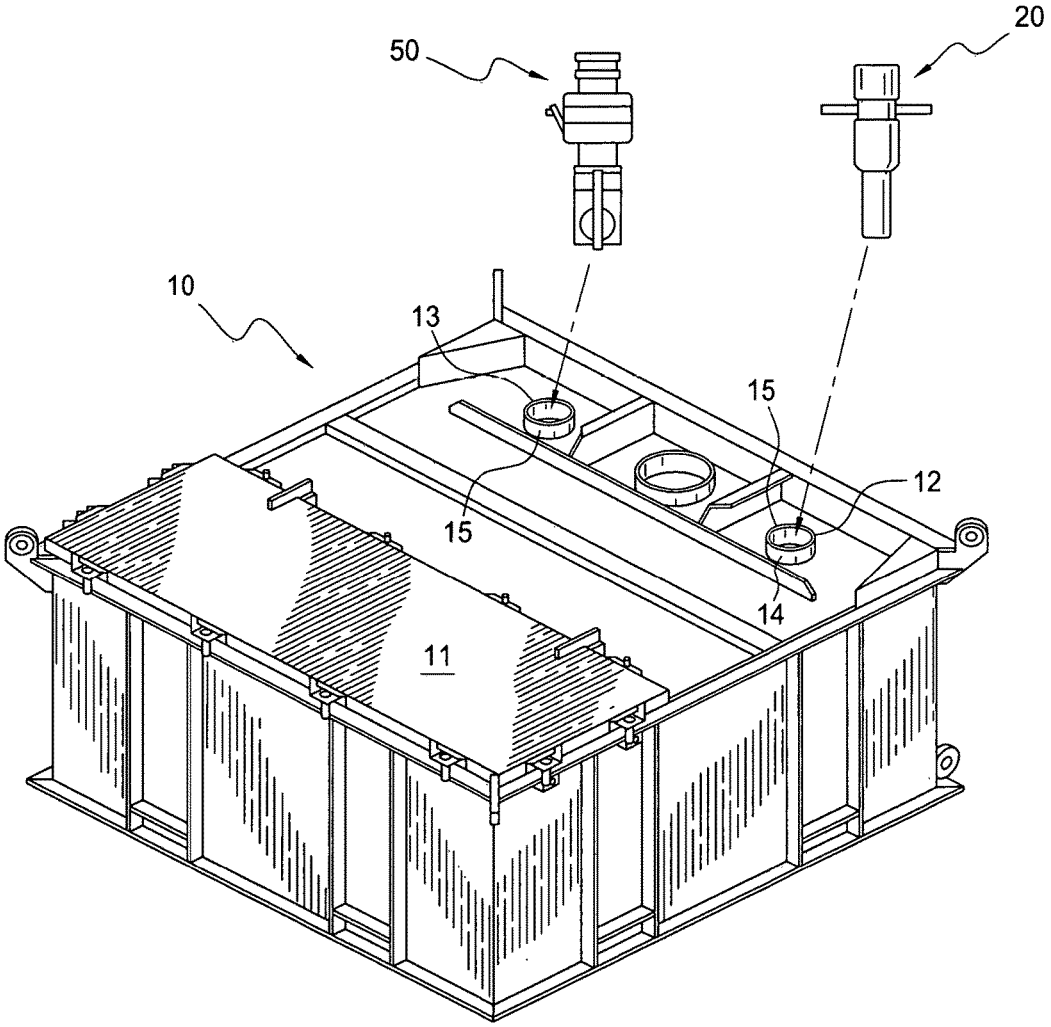
FIG. 1 illustrates a cuttings box showing the check valve assembly and the diverter assembly of the present invention.

Referring now to FIG. 1, the apparatus and method of the present invention involves a cuttings box 10, a diverter assembly 20, and a float assembly 50. Cuttings box 10 can be any of the many large boxes used in various industries to transport and dispose of drill cuttings. These large boxes are known as "cuttings boxes," and can have a capacity of twenty-five (25) oil field barrels. These large boxes are typically low profile and usually have a stackable design. These boxes are typically made of metal and come equipped with an inspection hatch, fork lift slots, lift eyes, and a pressure relief valve.

Diverter assembly 20 is preferably removably and sealably attached to an inlet opening 12 on the top 11 of cuttings box 10. Inlet opening 12 is typically round and has a cylindrical lip 14 extending upwardly from top 11 of cuttings box 10. Inlet opening 12 also typically has a top edge 15 to facilitate a sealed connection between diverter assembly 20 and inlet opening 12, as discussed in more detail below. A hose, pipe, or other conduit (not shown) is typically connected to diverter assembly 20 to facilitate the flow of drill cuttings into cuttings box 10 through diverter assembly 20.

Figure 2:
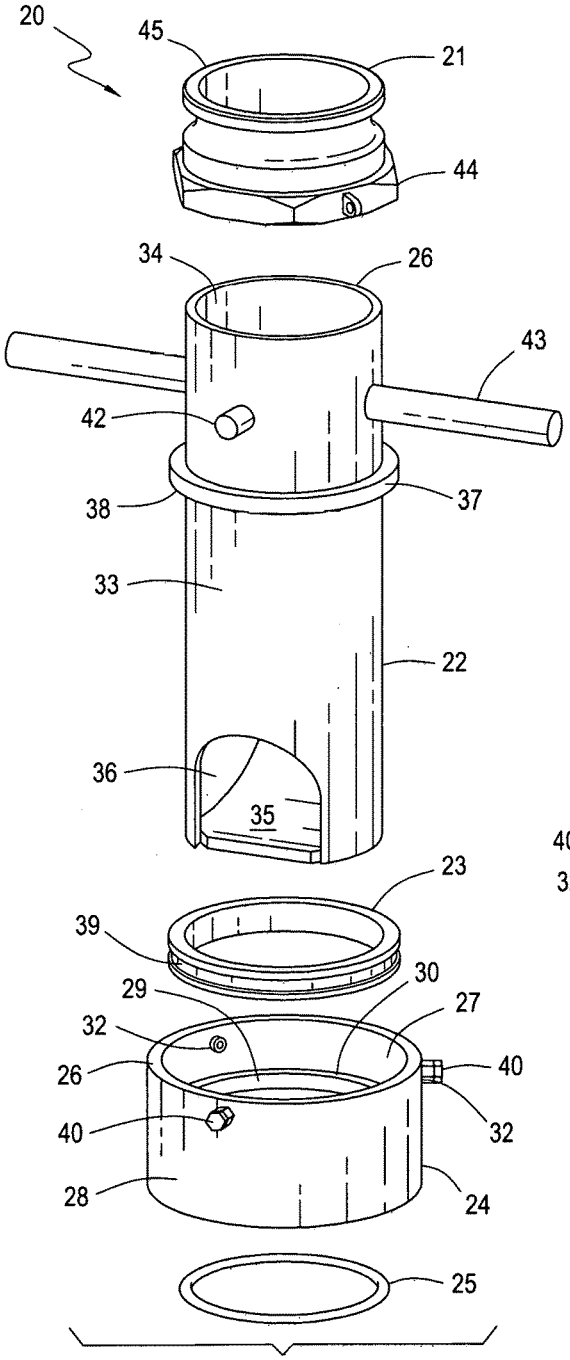
FIG. 2 is an exploded, isometric view of the diverter assembly of the present invention.
Figure 3:
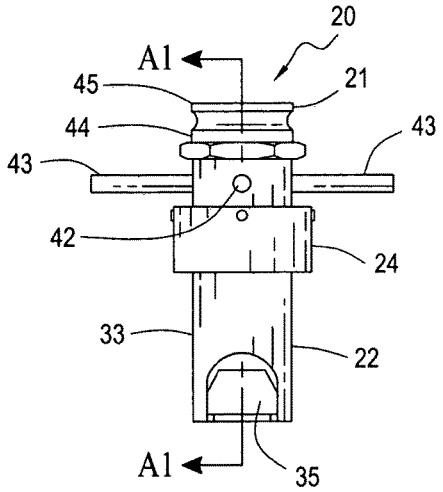
FIG. 3 is a side view of the diverter assembly of the present invention.
Figure 4:
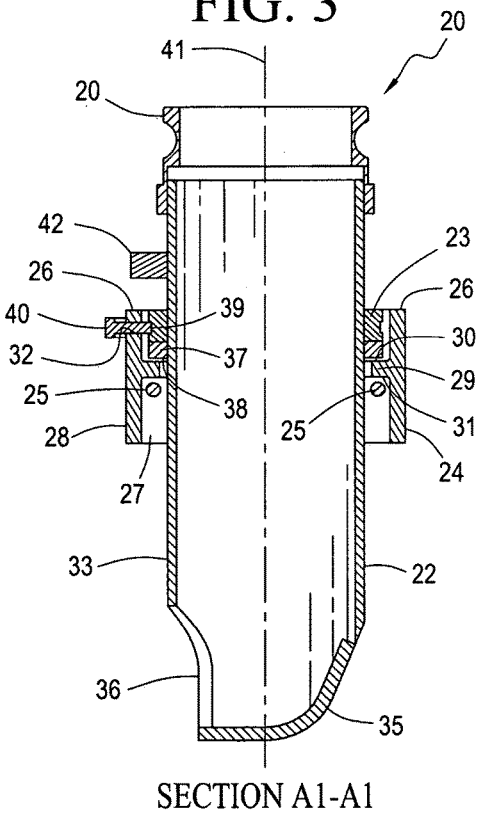
FIG. 4 is a side, cutaway view of the diverter assembly of the present invention.

Referring to FIGS. 2, 3, and 4, diverter assembly 20 includes a fitting 21, a diverter conduit 22, a retainer ring 23, a coupler 24, and a seal 25. Diverter assembly 20 is preferably made of metal and can be removably fitted onto inlet opening 12 of cuttings box 10. Diverter assembly 20 has a 360 degree rotational feature which allows an operator to control the direction of the drill cuttings entering cuttings box 10 to maximize the amount of drill cuttings fed into cuttings box 10 before cuttings box 10 reaches its capacity.

Still referring to FIGS. 2, 3, and 4, coupler 24 is preferably made of metal and can be cylindrically shaped. Coupler 24 preferably has a top edge 26, an inner surface 27, and an outer surface 28. Coupler 24 preferably has an inner diameter large enough to removably and sealably fit over cylindrical lip 14 of inlet opening 12 of cuttings box 10, as discussed in more detail below.

Referring to FIGS. 2 and 4, coupler 24 preferably has an inner ring 29 circling inner surface 27, which creates an upper shoulder 30 and a lower shoulder 31 adjacent to inner surface 27 of coupler 24. Inner ring 29 preferably has an inner diameter which is less than the outer diameter of cylindrical lip 14 of inlet opening 12 of cuttings box 10, so that when coupler 24 is removably and sealably fit over cylindrical lip 14 of inlet opening 12 of cuttings box 10, inner ring 29 remains above top edge 15 of cylindrical lip 14.

As shown in FIG. 2, coupler 24 preferably has a set of holes 32 spaced around coupler 24 between top edge 26 of coupler 24 and upper shoulder 30 of inner ring 29. Each hole 32 preferably extends radially from inner surface 27 to outer surface 28 of coupler 24.

When coupler 24 is removably and sealably fit over cylindrical lip 14 of inlet opening 12 of cuttings box 10, seal 25 is preferably placed between top edge 15 of cylindrical lip 14 and lower shoulder 31 of inner ring 29 of coupler 24 to prevent air from entering cuttings box 10 when diverter assembly 20 is attached to inlet opening 12 on the top 11 of cuttings box 10. Seal 25 is preferably made from a compressible material used in sealing applications known in the art.

Referring to FIGS. 2, 3, and 4, diverter conduit 22 is preferably made of metal pipe and has an outer surface 33, an open top 34, and a concaved-shaped bottom 35 designed to direct drill cuttings toward and through a side opening 36. The outer diameter of diverter conduit 22 is preferably slightly less than the inner diameter of inner ring 29 of coupler 24 to allow diverter conduit 22 to rotatably slide through coupler 24.

As shown in FIGS. 2 and 4, diverter conduit 22 preferably has an outer ring 37 fixed to outer surface 33 near open top 34 of diverter conduit 22. Outer ring 37 preferably has a lower shoulder 38 adjacent to outer surface 33 of diverter conduit 22. Outer ring 37 preferably has an outer diameter less than the inner diameter of inner surface 27 of coupler 24, but outer ring 37 preferably has an outer diameter greater than the inner diameter of inner ring 29 of coupler 24, so that when diverter conduit 22 is inserted into coupler 24, outer ring 37 fits inside-coupler 24 until lower shoulder 38 of outer ring 37 comes into contact with inner ring 29 of coupler 24. Outer ring 37 is preferably fixed to outer surface 33 at a position where side opening 36 of diverter conduit 22 is located below coupler 24 and inlet opening 12 of cuttings box 10 when diverter conduit 22 is inserted into coupler 24 and outer ring 37 comes into contact with inner ring 29 of coupler 24.

Still referring to FIGS. 2 and 4, retainer ring 23 is preferably made of metal and has an inner diameter slightly greater than the outer diameter of diverter conduit 22 so that retainer ring 23 can be slidably and rotatably fitted around outer surface 33 of diverter conduit 22. Retainer ring 23 preferably has an outer diameter slightly less than the inner diameter of inner surface 27 of coupler 24, so that when diverter conduit 22 is inserted into coupler 24 and lower shoulder 38 of outer ring 37 has made contact with inner ring 29 of coupler 24, retainer ring 23 can be placed on top of outer ring 37 in the annular space between diverter conduit 22 and coupler 24, as shown in FIG. 4.

As shown in FIGS. 2 and 4, retainer ring 23 preferably has an outer groove 39, so that when diverter conduit 22 is inserted into coupler 4, and lower shoulder 38 of outer ring 37 has made contact with inner ring 29 of coupler 24, and retainer ring 23 is placed on top of outer ring 37 in the annular space between diverter conduit 22 and coupler 24, outer groove 39 lines up with set of holes 32 of coupler 24. Retainer ring 23 can be secured in fixed relation to coupler 24 using adjustable retainer bolts 40 extending through set of holes 32. In the preferred embodiment of the present invention, adjustable retainer bolts have male threads that match female threads in set of holes 32. When retainer ring 23 is secured in fixed relation to coupler 24, as described above, diverter conduit 22 is prevented from moving vertically through coupler 24, but is allowed to rotate 360 degrees around the vertical axis 41 of diverter conduit 22.

In the preferred embodiment of the present invention, a direction indicator 42 can be attached to outer surface 33 of diverter conduit 22 between open top 34 of diverter conduit 22 and outer ring 37 of diverter conduit 22, as shown in FIGS. 2, 3, and 4. Direction indicator 42 is preferably made of metal and should be vertically aligned with side opening 36 of diverter conduit 22 to provide an operator of the present invention an indication of the direction of drilling cuttings flowing out of side opening 36 into cutter box 10.

In the preferred embodiment of the present invention, at least one handle 43 can be attached to outer surface 33 of diverter conduit 22 between open top 34 of diverter conduit 22 and outer ring 37 of diverter conduit 22, as shown in FIGS. 2 and 3. Handle 43 is preferably made of metal and should be designed to allow an operator of the present invention to manually rotate diverter conduit 22 in coupler 24.

In the preferred embodiment of the present invention, a camlock fitting 44 with a male camlock end 45 can be attached to open top 34 of diverter conduit 22. Camlock fitting 44 is preferably made of metal and should be designed for quickly connecting a hose, pipe, or other conduit to diverter assembly 20 to facilitate the flow of drill cuttings into cuttings box 10 through diverter assembly 20.

Figure 5:
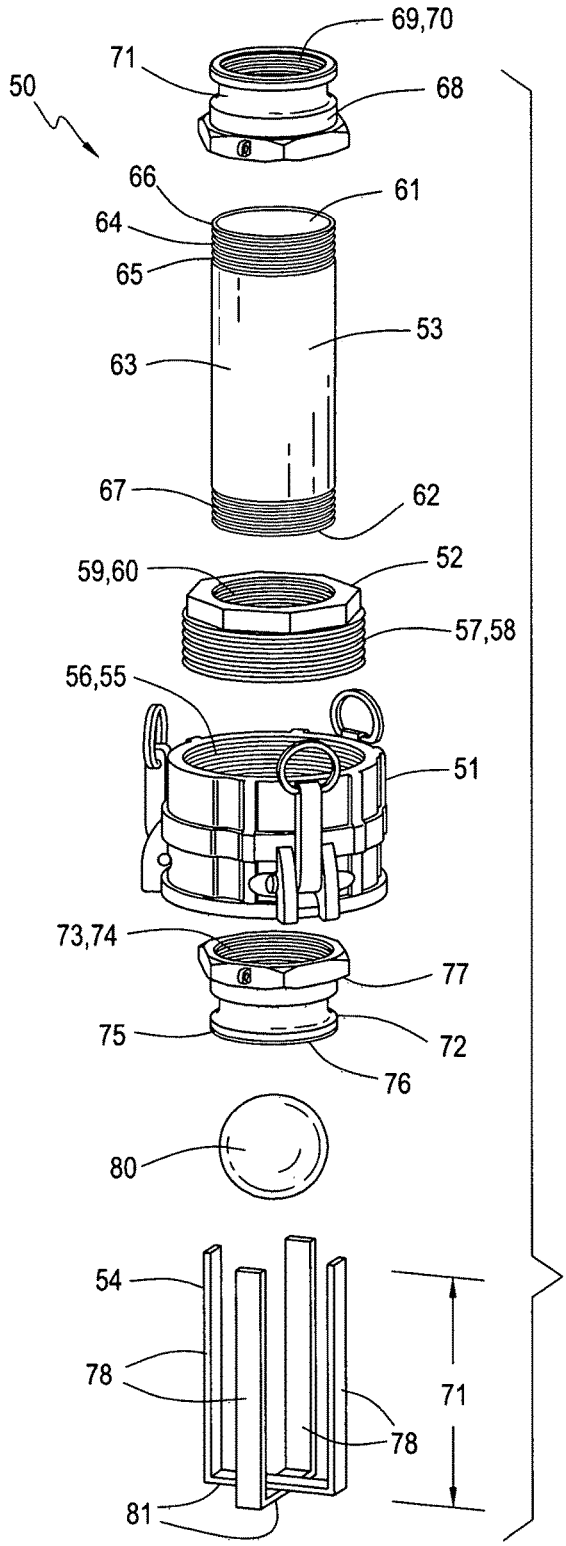
FIG. 5 is an exploded, isometric view of the ball check valve assembly of the present invention.
Figure 6:
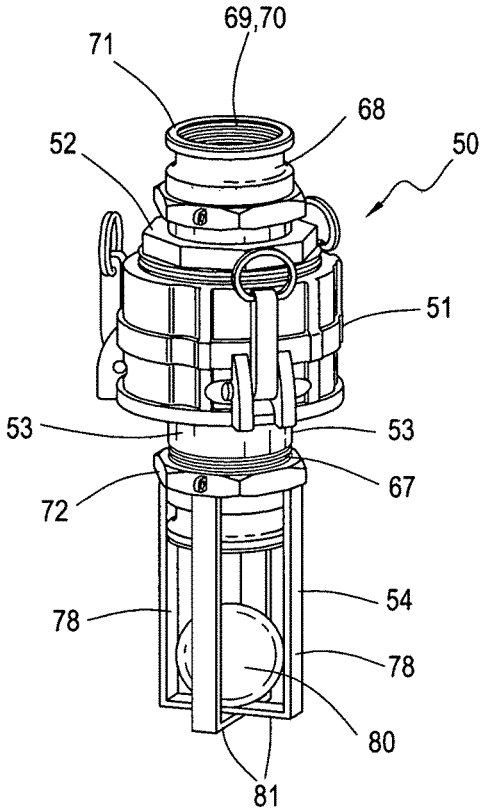
FIG. 6 is an isometric view of the ball check valve assembly of the present invention.

Referring now to FIGS. 5 and 6, float assembly 50 includes a coupler 51, a bushing 52, a nipple 53, and a float cage 54. Float assembly 50 is preferably made of metal and can be removably fitted onto outlet opening 13 of cuttings box 10. Float assembly 50 is preferably removably and sealably attached to an outlet opening 13 on top 11 of cuttings box 10. Similar to inlet opening 12, outlet opening 13 is typically round and has a cylindrical lip 16 extending upwardly from top 11 of cuttings box 10. A hose, pipe, or other conduit (not shown) is typically connected to float assembly 50 to connect a vacuum system (not shown) to cuttings box 10.

Still referring to FIGS. 5 and 6, coupler 51 is preferably made of metal and can be cylindrically shaped. Coupler 51 preferably has an inner diameter large enough to removably and sealably fit over cylindrical lip 16 of outlet opening 13 of cuttings box 10. Coupler 51 also preferably has an inner surface 55 equipped with female threads 56, as shown in FIG. 5.

Bushing 52 is preferably made of metal and can be cylindrically shaped. Bushing 52 preferably has an outer surface 57 equipped with male threads 58 that correspond with female 56 of inner surface 55 of coupler 51. Bushing 52 also preferably has an inner surface 59 equipped with female threads 60. In the preferred embodiment, bushing 52 is threadably attached to coupler 51 by threading male threads 58 of outer surface 57 of bushing 52 into female threads 56 of inner surface 55 of coupler 51, as shown in FIG. 6.

Nipple 53 is preferably made of metal and can be cylindrically shaped. Nipple 53 preferably has an open top 61, an open bottom 62, an outer surface 63 having male threads 64 adjacent to open top 61 and male threads 67 adjacent to open bottom 62. Male threads 64 adjacent to open top 61 of nipple 53 preferably divided into a lower portion 65 and an upper portion 66. Lower portion 65 of male threads 64 of nipple 53 are preferably threadably attached to female threads 60 of inner surface 59 of bushing 52 so that nipple 53 extends through coupler 51, as shown in FIG. 6.

In the preferred embodiment of the present invention, a cylindrically shaped camlock fitting 68 having an inner surface 69 equipped with female threads 70 can be threadably attached to upper portion 66 of male threads 64 on outer surface 63 adjacent to open top 61 of nipple 53, as shown in FIG. 6. Camlock fitting 68 is preferably made of metal and has a male camlock end 71 opposite nipple 53 for quickly connecting a hose, pipe, or other conduit to float assembly 50 to connect a vacuum system to cuttings box 10.

In the preferred embodiment of the present invention, a cylindrically shaped camlock fitting 72 having an inner surface 73 equipped with female threads 74 can be threadably attached to male threads 67 on outer surface 63 adjacent to open bottom 62 of nipple 53, as shown in FIG. 6. Camlock fitting 72 is preferably made of metal and has a male camlock end 75 opposite nipple 53. Camlock fitting 72 also preferably has a bottom outlet 76 and an outer shoulder 77, as shown in FIG. 5.

Float cage 54 is preferably equipped with a plurality of vertical bars 78 attached to outer shoulder 77 of camlock fitting 72, as shown in FIG. 6. Vertical bars 78 preferably have sufficient length 79 to prevent a float 80 contained within float cage 54 from being sucked into bottom outlet 76 of camlock fitting 72 when cuttings box 10 is not filled with drill cuttings. Float cage 54 is also preferably equipped with horizontal bars 81 that connect plurality of vertical bars 78 opposite bottom outlet 76 of camlock fitting 72. Float 80 is preferably shaped to seal bottom outlet 76 of camlock fitting 72 when the level of drill cuttings in cuttings box 10 lifts float 80 close enough to bottom outlet 76 of camlock fitting 72 to enable a vacuum system pulling air through float assembly 50 to pull float 80 into bottom outlet 76 of camlock fitting 72 to create a seal. The seal causes a noticeable change in the sound of the vacuum system, signaling the operator of the present invention that cuttings box 10 is full.

In use, diverter assembly 20 and float assembly 50 are connected to inlet opening 12 and outlet opening 13, respectively, of an empty cuttings box 10. A hose, pipe, or other conduit is connected to diverter assembly 20 to facilitate the flow of drill cuttings into cuttings box 10 through diverter assembly 20. A hose, pipe, or other conduit is connected to float assembly 50 to connect a vacuum system to the empty cuttings box 10. The vacuum system is switched on the begin sucking drill cuttings into cuttings box 10 through diverter assembly 20. As portions of cuttings box 10 begin to fill up with drill cuttings, diverter conduit 22 is rotated on vertical axis 41 to direct drill cuttings through side opening 36 of diverter conduit 22 to other portions of cuttings box 10. Once cuttings box 10 is completed filled to capacity, diverter assembly 20 and float assembly 50 are removed from the filled cuttings box 10 and transferred to an empty cuttings box 10 to repeat the process.

It is understood that one embodiment of the present invention has been disclosed by way of example and that other modifications and alterations may occur to those skilled in the art without departing from the scope and spirit of the appended claims.

What is claimed is:

1. A drill cuttings diverter system for distributing drill cuttings inside a cuttings box having an inlet opening and an outlet opening, said drill cuttings diverter system comprising:

(a) a first coupler connected to said inlet opening of said cuttings box;

(b) a diverter conduit having a vertical axis, an outer surface, an open top, and a bottom concaved toward a side opening, said diverter conduit rotatably disposed through said first coupler so that said open top of said diverter conduit is above said inlet opening of said cuttings box and said side opening of said diverter conduit is below said inlet opening of said cuttings box, where said diverter conduit is fixed vertically with respect to said inlet opening of said cuttings box and said diverter conduit is free to rotate about said vertical axis of said diverter conduit;

(c) a second coupler attached to said outlet opening of said cutting box;

(d) a bushing attached to said second coupler;

(e) a nipple having an open top and an open bottom, said nipple attached to said bushing so that said open top of said nipple extends above said second coupler and said open bottom of said nipple extends below said second coupler; and (f) a float cage attached to said open bottom of said nipple, where said float cage extends below said open bottom of said nipple, said float cage containing a float that is capable of sealing said open bottom of said nipple when sufficient suction is created through said nipple.

2. The cuttings diverter system of claim 1, further comprising a direction indicator attached to said outer surface of said diverter conduit above said inlet opening of said cuttings box, where said direction indicator is in vertical alignment with said side opening of said diverter conduit.

3. The cuttings diverter system of claim 2, further comprising at least one handle attached to said outer surface of said diverter conduit above said inlet opening of said cuttings box for rotating said diverter conduit about said vertical axis of said diverter conduit.

4. The cuttings diverter system of claim 3, where said first coupler is cylindrically shaped and is equipped with an inner ring.

5. The cuttings diverter system of claim 4, where said first coupler is equipped with a plurality of holes extending radially through said first coupler above said inner ring.

6. The cuttings diverter system of claim 5, where said diverter conduit is cylindrically shaped and is equipped with an outer ring that interacts with said inner ring of said first coupler to prevent said diverter conduit from falling through said inlet opening into said cuttings box.

7. The cuttings diverter system of claim 6, further comprising a retainer ring slidably and rotatably fitted around said diverter conduit above said outer ring of said diverter conduit, said retainer ring having an outer groove positioned on said retainer ring so that when said diverter conduit is disposed through said inlet opening of said cuttings box, and when said inner ring of said first coupler is interacting with said outer ring of said diverter conduit to prevent said diverter conduit from falling through said inlet opening into said cuttings box, said outer groove of said retainer ring is aligned with said plurality of holes extending radially through said first coupler.

8. The cuttings diverter system of claim 7, further comprising an adjustable retainer bolt extending through each of said plurality of holes extending radially through said first coupler for securing said retainer ring in fixed relation to said first coupler while allowing said diverter conduit to rotate about said vertical axis of said diverter conduit.

9. The cutting diverter system of claim 8, further comprising a camlock fitting attached to said open top of said diverter conduit, said camlock fitting having a male camlock end opposite said open top of said diverter conduit.

10. The cuttings diverter system of claim 9, where said second coupler is cylindrically shaped, where said second coupler is removably and sealably attached to said outlet opening of said cutting box, and where said second coupler has an inner surface with female threads.

11. The cuttings diverter system of claim 10, where said bushing is cylindrically shaped and has an outer surface with male threads removably attached to said female threads on said inner surface of said second coupler, and where said bushing has an inner surface with female threads.

12. The cuttings diverter system of claim 11, where said nipple is cylindrically shaped and has an outer surface having male threads adjacent to said open top, said male threads having a lower portion and an upper portion, said lower portion of said male threads being removably attached to said female threads of said inner surface of said bushing so that said nipple extends through said second coupler.

13. A drill cuttings diverter system for distributing drill cuttings inside a cuttings box, said drill cuttings diverter system comprising:

(a) a cuttings box having a top, said top of said cuttings box having a round inlet opening and a round outlet opening, said round inlet opening having a cylindrical lip extending upwardly from said round inlet opening, said cylindrical lip of said round inlet opening having a top edge and an outer diameter, said round outlet opening having a cylindrical lip extending upwardly from said round outlet opening, said cylindrical lip of said round outlet opening having a top edge and an outer diameter;

(b) a diverter assembly removably disposed through said round inlet opening of said top of said cuttings box, said diverter assembly comprising:

(i) a cylindrical coupler having a top edge, an inner surface, and an outer surface, said inner surface of said cylindrical coupler having an inner diameter greater than said outer diameter of said cylindrical lip of said round inlet opening of said top of said cuttings box, said cylindrical coupler having an inner ring around said inner surface of said cylindrical coupler, said inner ring having an inner diameter less than said outer diameter of said cylindrical lip of said round inlet opening of said top of said cuttings box, said inner ring creating an upper shoulder and a lower shoulder adjacent to said inner surface of said cylindrical coupler, said cylindrical coupler having a plurality of holes between said top edge of said cylindrical coupler and said upper shoulder of said inner ring around said inner surface of said cylindrical coupler, said plurality of holes extending radially from said inner surface to said outer surface of said cylindrical coupler;

(ii) a compressible ring seal disposed between said top edge of said cylindrical lip of said round inlet opening of said top of said cuttings box and said lower shoulder of said inner ring of said cylindrical coupler for creating a seal between said cuttings box and said diverter assembly;

(iii) a diverter conduit having an outer surface, an outer diameter, an open top, and a bottom concaved toward a side opening, said outer diameter of said diverter conduit being slightly less than said inner diameter of said inner ring around said inner surface of said cylindrical coupler, said diverter conduit having a fixed outer ring around said outer surface of said diverter conduit, said fixed outer ring having an outer diameter less than said inner diameter of said inner surface of said cylindrical coupler, said outer diameter of said fixed outer ring being greater than said inner diameter of said inner ring of said cylindrical coupler, said fixed outer ring creating a lower shoulder adjacent to said outer surface of said diverter conduit opposite said upper shoulder of said inner ring of said coupler assembly for preventing said diverter assembly from falling into said cuttings box;

(iv) a retainer ring slidably and rotatably fitted around said outer surface of said diverter conduit between said open top of said diverter conduit and said fixed outer ring of said diverter conduit, said retainer ring having an outer groove, so that when said diverter assembly is disposed through said round inlet opening of said top of said cuttings box, said outer groove of said retainer ring is aligned with said plurality of holes extending radially from said inner surface to said outer surface of said cylindrical coupler;

(v) an adjustable retainer bolt extending through each of said plurality of holes radially extending from said inner surface to said outer surface of said cylindrical coupler for temporarily securing said retainer ring in fixed relation to said cylindrical coupler while allowing said diverter conduit to rotate in said cylindrical coupler;

(vi) a direction indicator attached to said outer surface of said diverter conduit between said open top of said diverter conduit and said fixed outer ring around said outer surface of said diverter conduit, said direction indicator being vertically aligned with said side opening of said diverter conduit;

(vii) at least one handle attached to said outer surface of said diverter conduit between said open top of said diverter conduit and said fixed outer ring around said outer surface of said diverter conduit for rotating said diverter conduit in said cylindrical coupler; and (viii) a first camlock fitting attached to said open top of said diverter conduit;

(c) a float assembly removably disposed through said round outlet opening of said top of said cuttings box, said float assembly comprising:

(i) a cylindrical fitting removably and sealably attached to said round outlet opening of said top of said cutting box, said cylindrical fitting having an inner surface with female threads;

(ii) a reducer bushing having an outer surface with male threads removably attached to said female threads on said inner surface of said cylindrical fitting; said reducer bushing having an inner surface with female threads;

(iii) a nipple having an open top, an open bottom, and an outer surface having male threads adjacent to said open top, said male threads having a lower portion and an upper portion, said lower portion of said male threads being removably attached to said female threads of said inner surface of said reducer bushing so that said nipple extends through said cylindrical fitting, said nipple having male threads on said outer surface adjacent to said open bottom of said nipple;

(iv) a second camlock fitting having an inner surface with female threads removably attached to said upper portion of said male threads on said outer surface adjacent to said open top of said nipple;

(v) a third camlock fitting having an inner surface with female threads removably attached to said male threads on said outer surface adjacent to said open bottom of said nipple; said third camlock fitting having a bottom outlet and an outer shoulder;

(vi) a float cage fixed to said outer shoulder of said third camlock fitting, where said float cage extends below said bottom outlet of said third camlock fitting, said float cage containing a float that is capable of sealing said bottom outlet of said third camlock fitting when sufficient suction is created through said float assembly.

14. The drill cuttings diverter system of claim 13, where said float is shaped like a ball.

15. A method for distributing drill cuttings inside a cuttings box having an inlet opening and an outlet opening, said method comprising the steps of:

(a) providing a cylindrical coupler connected to said inlet opening of said cuttings box;

(b) providing a diverter conduit having a vertical axis, an outer surface, an open top, and a bottom concaved toward a side opening, and disposing said diverter conduit through said cylindrical coupler so that said open top of said diverter conduit is above said inlet opening of said cuttings box and said side opening of said diverter conduit is below said inlet opening of said cuttings box, where said diverter conduit is fixed vertically with respect to said cylindrical coupler and said diverter conduit is free to rotate about said vertical axis of said diverter conduit;

(c) providing a means for rotating said diverter conduit about said vertical axis to change direction of cuttings flowing through said side opening of said bottom of said diverter conduit into said cuttings box;

(d) providing a cylindrical fitting attached to said outlet opening of said cutting box;

(e) providing a reducer bushing attached to said cylindrical fitting;

(f) providing a nipple having an open top and an open bottom, and extending said nipple through said reducer bushing so that said open top of said nipple extends above said cylinder fitting and said open bottom of said nipple extends below said cylindrical fitting;

(g) providing a float cage that extends below said open bottom of said nipple; and (h) providing a float inside said float cage, where said float is capable of sealing said open bottom of said nipple.

16. The method of claim 15, further comprising the step of providing a direction indicator attached to said outer surface of said diverter conduit above said inlet opening of said cuttings box and in vertical alignment with said side opening of said diverter conduit.

17. The method of claim 16, further comprising the steps of:

(a) connecting a drill cuttings supply to said open top of said diverter conduit; and (b) connecting a vacuum system to said open top of said nipple to draw drill cuttings into said cuttings box through said diverter conduit until said drill cuttings in said cuttings box causes said float to seal said open bottom of said nipple.

* * * * *